United States Patent [19]

Coleman et al.

[11] 4,202,594

[45] May 13, 1980

[54] RF CONNECTOR ASSEMBLY INCLUDING MOUNTING APPARATUS FOR A WASHER-LIKE CAPACITOR

[75] Inventors: Clyde F. Coleman, Crawfordsville; Myron C. Stewart, Coatesville, both of Ind.

[73] Assignee: RCA Corporation, New York, N.Y.

[21] Appl. No.: 969,782

[22] Filed: Dec. 15, 1978

[51] Int. Cl.[2] ..... H01R 3/06

[52] U.S. Cl. ..... 339/147 R; 333/206; 339/143 R

[58] Field of Search ..... 339/177 R, 177 E, 147; 361/302, 306; 333/206

[56] References Cited

U.S. PATENT DOCUMENTS

| | | | |
|---|---|---|---|
| 2,973,490 | 2/1961 | Schlicke | 361/302 X |
| 3,106,687 | 10/1963 | Bowman | 333/206 X |
| 3,443,251 | 5/1969 | Garstang et al. | 339/147 UX |
| 3,447,104 | 5/1969 | Schor | 361/302 X |

*Primary Examiner*—Roy Lake
*Assistant Examiner*—Eugene F. Desmond
*Attorney, Agent, or Firm*—E. M. Whitacre; J. S. Tripoli

[57] ABSTRACT

In an RF coaxial connector assembly, apparatus is provided for mounting a washer-like capacitor. The capacitor is used for providing DC and low frequency isolation between the outer conductor of the connector and the device to which the connector is attached. The mounting apparatus comprises an insulating sleeve for containing the washer-like capacitor. The apparatus further comprises a mechanism for locking the capacitor in place within the sleeve.

9 Claims, 3 Drawing Figures

RF CONNECTOR ASSEMBLY INCLUDING MOUNTING APPARATUS FOR A WASHER-LIKE CAPACITOR

The present invention relates generally to RF connectors of the type including a washer-like capacitor for providing a distributed capacitance and more particularly to such an RF connector assembly including specialized mounting apparatus for the washer-like capacitor.

In U.S. patent application Ser. No. 969,782 filed concurrently herewith in the names of J. P. Yu and D. J. Carlson, an RF connector assembly is described which includes a washer-like capacitor. This form of RF coaxial connector assembly is intended to provide DC and low frequency isolation between the outer conductor of the connector and the chassis wall to which it is attached. As indicated in the aforementioned application, such a connector is very useful in application where two devices are connected together via a coaxial cable, for example, a video disc player and a television receiver. In such a system, the RF connector with the distributed capacitance would be attached to the video disc player. In the event of a fault in the television receiver which might cause the TV chassis to become potentially hazardous, the RF connector assembly with its distributed capacitor, would be effective to prevent the video disc player from conducting electricity on its outer metal parts. Isolation of the two devices is of concern for at least two reasons. There is concern that a user touching a metal part of the player chassis might experience a shock, and there is concern over potential damage to the video disc player itself resulting from a fault in the TV receiver.

As described in the aforementioned application, the distributed capacitance is provided through the use of a washer-like ceramic capacitor having electrodes deposited on each of its major flat surfaces. This capacitor is slipped over the outer conductor of the coaxial connector and electrical connection is made to the capacitor via the deposited electrodes. This capacitor is effectively connected between the outer conductor of the RF connector assembly and the wall of the utilization device to which it is attached. In this way, the capacitor with its uniformly distributed capacitance prevents the flow of DC and low frequency currents over the outer conductor to the device while still permitting the normal flow of the very high frequency RF currents. An advantage of the use of a washer-like capacitor in this form of RF connector assembly is that the capacitor element does not require wire leads. Such wire leads could very well form an undesirable inductance at high RF frequencies.

Typically, an RF connector, as described above, includes a tube-like housing which is threaded and forms the outer conductor of the coaxial connector. When the washer-like capacitor is fitted over the outer conductor, typically a conductive washer and a nut are placed over the outer conductor to secure the assembly. There is a problem, however, when the nut is tightened down on the outer conductor of the connector. If the nut is tightened down too hard, there will be a transfer of wrenching torque forces applied to the ceramic capacitor. Since the ceramic capacitor is generally brittle device, it does not take very much force to chip or crack the capacitor.

The present invention provides apparatus for mounting a washer-like capacitor in an RF connector assembly which prevents the application of excessive force to the capacitor as well as protection of the capacitor from environmental factors, and, in addition, provides the desired electrical contact to each of the capacitor electrodes.

In accordance with the present invention, an RF connector assembly is provided which has an inner conductor and a coaxial tube-like outer conductor. The connector assembly is adapted for receiving a washer-like capacitor. A conductive electrode is provided on each of the major flat surfaces of the capacitor. One of the electrodes is electrically connected to the outer conductor and the other of the electrodes is connected to a device to which the connector assembly is attached. The capacitor is fitted over the outer conductor for providing DC and low frequency isolation between the outer conductor and the device. In such an assembly, the present invention provides the improvement comprising a holder means fitted over the outer conductor and adapted for receiving the washer-like capacitor. In the drawing:

Figure 1:
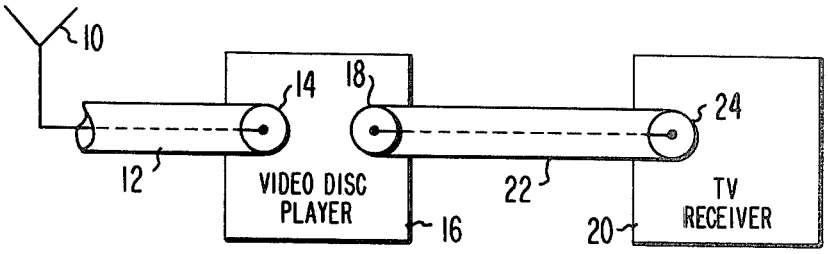
FIG. 1 is a block diagram used to illustrate the location of the RF connectors in accordance with the present invention in a typical system.

Referring now to FIG. 1, an antenna 10 is connected via an RF cable 12 to an RF connector 14 which is typically located on the back chassis wall of a video disc player 16. In the system shown, the cable 12 is a coaxial cable. In such an instance it would be desirable to have the RF connector 14 built in accordance with the principles of the present invention. In the event that the cable 12 is a twin lead cable, then some other form of connector would be used in place of the RF connector 14. Alternatively, in the case of twin lead, an adaptor could be used to couple the twin lead to RF connector 14. The adaptor would be in the form of a matching transformer.

Another RF connector 18, which is coaxial in form, is used for connecting the video disc player 16 to a television receiver 20 via an RF cable 22. In this case, cable 22 is a coaxial cable for coupling RF signals from connector 18 to RF connector 24 which is located on the back panel of the television receiver 20.

The video disc player 16 is arranged such that when it is operative, that is, when a record is being played back and displayed on the TV receiver 20, the signals picked up by antenna 10 and coupled to the video disc player 16 are coupled to a dummy load within the video disc player. In this way, off-the-air signals are prevented from reaching the TV receiver. Conversely, when the video disc player is switched off, a mechanism which is provided within the player 16 permits the off-the-air signals picked up by antenna 10 to be coupled through the video disc player and into the TV receiver via coaxial cable 22.

Figure 2:
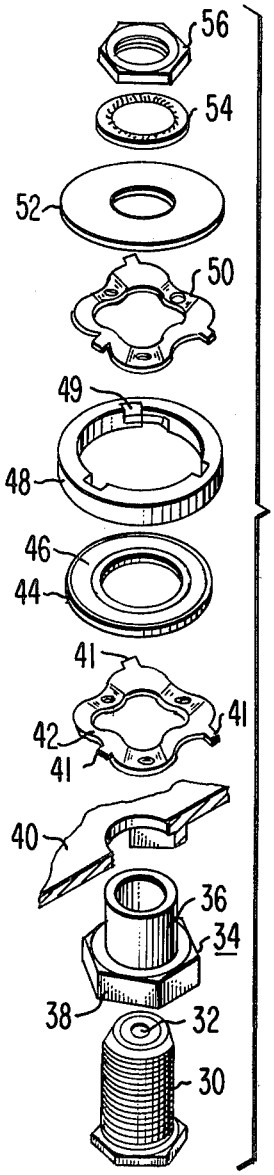
FIG. 2 is an assembly drawing of the components of an RF connector in accordance with the principles of the present invention.

Referring now to FIG. 2, the RF connector assembly comprises an outer conductor, tube-like housing 30 which is made from a conductive metal such as cadmium plated brass. An inner conductor 32 is coaxial with the tube-like housing 30. An insulating bushing 34 is also provided and is arranged to fit over the tube-like housing 30. The insulating bushing 34 includes a sleeve member 36 and a nut-like member 38. The lower nut-like portion 38 of the insulator 34 is adapted to receive the nut portion of the outer conductor 30 shown at the base thereof in FIG. 2. This arrangement, when connected together in the final assembly, prevents the rotation of the tube-like housing with respect to the insulating bushing 34. That is, the nut portion of outer conductor 30 is captured within the nut-like member 38 of insulating bushing 34.

The outer conductor 30 is inserted through the insulating bushing 34 and the sleeve portion 36 is adapted to pass through an opening in the chassis wall shown in FIG. 2 as 40. When assembled, of course, the tube-like outer conductor 30, which is a threaded member, will extend substantially through insulating bushing 34 and the hole in the metal chassis wall 40. The shoulder of insulating bushing 34 at the base of the sleeve portion 36 is made to bear upon a major surface of the metal chassis wall 40.

On the other side of chasssis wall 40, a spring or wave-type electrically conductive washer 42 is located and is adapted for sliding over the sleeve portion 36 of the insulating bushing 34. Spring washer 42 includes tabs 41 located on the outer circumference thereof. In the arrangement shown in FIG. 2 there are three such tabs equally spaced about the outer periphery of washer 42.

On the other side of spring washer 42 is located the washer-like capacitor 44. Capacitor 44 is typically a ceramic type capacitor having an electrically conductive material 46 deposited upon each of the major flat surfaces thereof. Capacitor 44 is thus completely symmetrical. The center hole in this washer-like capacitor 44 is made large enough so as to fit over the sleeve element 36 of the insulating bushing 34. That is, the diameter of the hole in the capacitor 44 is larger than the outer diameter of the sleeve portion 36. The dimension of capacitor 44 in the axial direction is selected so that the sleeve portion 36 does not extend all the way through the washer-like capacitor 44 in the final assembly.

As shown in FIG. 2 on the other side of capacitor 44, there is an insulating sleeve 48. Insulating sleeve 48 is made large enough in the axial direction to accept washer 42, capacitor 44 and a second spring-like electrically conductive washer 50 within its axial dimension. The inner diameter of the sleeve insulator 48 is arranged to accept the outer diameter of the washer-like capacitor 44. Insulating sleeve 48 also includes three cut-outs extending from the upper flat surface thereof down to a first level within the sleeve. Similar cut-outs are also included which extend from the other major flat surface of insulator sleeve 48 up to a second level within the sleeve 48. At each of these levels there is located a locking ramp. Details of the cut-outs 49 and the associated locking ramps will be described more fully in connection with FIG. 3.

It will now be seen that the sleeve 48 in the assembly is fitted over the capacitor 44 and the spring washer 42 has its tabs inserted into one set of the cut-outs 49 and is then twisted so that the tabs rest in the locked position. The capacitor 44 is then placed within the sleeve 48. The tabs of the second spring washer 50 are then set into the other cut-outs and this washer is then twisted so as to place those tabs beyond the second set of locking ramps. Each of washers 42 and 50 include small through holes to receive the prongs of a tool for facilitating the twisting action. When assembled in this fashion, there is in effect a sandwich created comprising spring washer 42, capacitor 44 and spring washer 50 all contained within the insulating sleeve 48. The washers 42 and 50 are not flat and have portions which extend beyond the upper and lower flat surfaces of insulator 48. In addition, because of their wave or spring-like structure, washers 42 and 50 make contact in several places with the electrodes deposited on each side of capacitor 44. When washers 42 and 50 are locked in place, they hold capacitor 44 in a fixed position relative to the sleeve 48.

Completing the RF connector assembly is a flat washer 52, a lock washer 54 and finally a nut 56.

Figure 3:
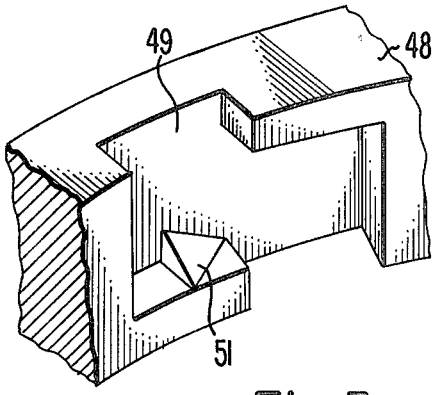
FIG. 3 is a portion of a perspective view of the insulating sleeve shown in FIG. 2.

Referring now to FIG. 3, there is shown a portion of insulating sleeve 48 for the purpose of illustrating the arrangement for each of the cut-outs and locking ramps. As shown therein, a cut-out 49 extends from one flat surface down to a first level of the insulator sleeve 48. At this first level, there is located a locking ramp 51. Adjacent to cut-out 49 there is a similar cut-out which extends from the other flat surface of sleeve 48 up to a second level. There is a similar locking ramp located at this second level. In other words, if one were to turn the sleeve 48 upside down and take a section similar to FIG. 3, the drawing would be identical. It will now be seen that when a tab 41 of a washer such as 42 is inserted in one of the cut-outs and the washer is then twisted, the tab will ride up the locking ramp 51 and fall into the position behind the locking ramp and will then be secured. Similarly, after the washer capacitor is placed in the sleeve 48 the second spring washer tab is inserted into the adjacent cut-out and then twisted in the opposite direction to ride up another locking ramp and spring into position at the second level behind the second locking ramp. In the disclosed embodiment, there are three points of contact between one spring washer and one side of the capacitor and three oppositely disposed points of contact between the other spring washer and the other side of the capacitor.

Referring back to FIG. 2, it will be seen that in the embodiment shown there are three equally spaced cut-outs extending from the upper flat surface of sleeve 48 and three cut-outs extending from the lower surface of sleeve 48.

Thus, in accordance with the disclosed RF connector assembly, there is provided a stress relieved mounting assembly for a washer-like capacitor arranged to prevent the transfer of wrenching torque to the capacitor. By locating the three contact points of the spring washers on opposite sides of the capacitor, only a controlled compressive force is present on the capacitor. No flexural stress is present. The mounting apparatus inherently maintains the washer-type capacitor 44 in a parallel condition within the sleeve 48. Another desirable feature of this mounting arrangement is that the capacitor and the spring washers are held in a self-contained package by the insulating sleeve 48. The locking ramps on the insulator spacer 48 are so positioned to further relieve stress on the capacitor 44 by allowing spring pressures to equalize each other. The spring washers also serve as the points of contact between the electrodes of the capacitor and the outer conductor 30 and the chassis wall 40. As a result of the manner in which sleeve 48 is arranged to hold capacitor 44, sleeve 48 also provides protection for the capacitor from the surrounding environment.

It will be appreciated that the principles of the present invention will be useful in many applications other than video disc players. The present invention will be useful in many other applications utilizing a coaxial connector assembly having a washer-like capacitor in the connection between two devices.

We claim:

1. In an RF connector assembly having an inner conductor and a coaxial tube-like outer conductor and adapted for receiving a washer-like capacitor, said capacitor having a conductive electrode on each of the opposing major flat surfaces thereof, one of said electrodes being electrically connected to said outer conductor and the other of said electrodes being adapted for electrical connection to a utilization device, said capacitor being fitted over said outer conductor for providing DC and low frequency isolation between said outer conductor and said utilization device, the improvement comprising:

holder means fitted over said outer conductor and adapted for receiving said washer-like capacitor.

2. The improvement according to claim 1 wherein said holder means includes a sleeve of insulating material for receiving said washer-like capacitor.

3. The improvement according to claim 2 wherein said holder means further comprises a means for locking said washer-like capacitor within said insulating sleeve.

4. The improvement according to claim 3 wherein said locking means includes first and second electrically conductive means respectively mounted in a fixed position on each side of said washer-like capacitor.

5. The improvement according to claim 4 wherein said first and said second electrically conductive means comprise first and second electrically conducting washers, each of said conducting washers being adapted for reception within said insulating sleeve on either side of said washer-like capacitor, each conductive washer being in electrical contact with the capacitor electrode adjacent thereto.

6. The improvement according to claim 5 wherein said insulated sleeve further comprises means for locking each of said first and second conducting washers in place within said sleeve.

7. An RF connector assembly for use with a utilization device, said assembly having an inner conductor and a coaxial tube-like outer conductor, said outer conductor being spirally threaded along the axial direction, said assembly being adapted for mounting on a wall of said device through a hole in said wall; said assembly comprising:

an insulating bushing fitted over at least a portion of said tube-like outer conductor and having a surface disposed perpendicularly with respect to said axial direction arranged for bearing upon one side of said wall, said insulating bushing being adapted for passing through said hole;

a washer-like capacitor, said capacitor having a conductive electrode on each of the opposing major flat surfaces thereof, said washer-like capacitor being adapted for being fitted over said insulating bushing and said outer conductor;

a first conductive spring washer adapted for being fitted over said insulating bushing and adapted for forming an electrical contact between the other side of said wall and one of said capacitor electrodes;

a second conductive spring washer adapted for being fitted over said insulating bushing and being positioned for electrical contact with the other one of said capacitor electrodes;

an insulating sleeve adapted to fit over said first and second spring washers and said washer-like capacitor, said sleeve being coaxial with said inner and outer conductors;

a conductive washer having a center hole sufficient for fitting over said outer conductor, said conductive washer being in electrical contact with said second spring washer; and a nut threaded onto said housing for exerting a force in the axial direction upon said conductive washer, said nut securing said assembly to said wall when tightened.

8. The assembly according to claim 7 wherein said insulating sleeve further comprises means for locking said first and second spring washers in place within said insulating sleeve.

9. The assembly according to claim 8 wherein said locking means comprises a first cutout extending from one major flat surface of said insulating sleeve to a first level within said insulating sleeve along the axial direction and a locking ramp positioned at said first level and a second cutout extending from the other major flat surface of said insulating sleeve to a second level within said insulating sleeve and another locking ramp positioned at said second level and wherein each of said first and second spring washers further includes a tab located along the outer circumference, said first spring washer tab being adapted for insertion in said first cutout and adapted for being locked in place by said first level locking ramp, said second spring washer tab being adapted for insertion in said second cutout and adapted for being locked in place by said second level locking ramp.

* * * * *